US006074288A

United States Patent [19]

Nagahara et al.

[11] Patent Number: 6,074,288

[45] Date of Patent: Jun. 13, 2000

[54] MODIFIED CARRIER FILMS TO PRODUCE MORE UNIFORMLY POLISHED SUBSTRATE SURFACES

[75] Inventors: Ronald J. Nagahara, San Jose; Dawn M. Lee, Morgan Hill, both of Calif.

[73] Assignee: LSI Logic Corporation, Milpitas, Calif.

[21] Appl. No.: 08/961,382

[22] Filed: Oct. 30, 1997

[51] Int. Cl.[7] ..... B24B 41/06

[52] U.S. Cl. ..... 451/384; 451/398; 451/41; 451/390

[58] Field of Search ..... 451/41, 42, 285, 451/283, 287, 288, 289, 388, 397, 398, 290, 384, 390, 364, 56; 156/345, 345 PL

[56] References Cited

U.S. PATENT DOCUMENTS

| | | | |
|---|---|---|---|
| 3,886,696 | 6/1975 | Bruck | 451/398 |
| 4,459,784 | 7/1984 | Hernandez et al. | 451/390 |
| 4,530,139 | 7/1985 | Miller | 29/25.35 |
| 4,918,869 | 4/1990 | Kitta | 451/288 |
| 5,036,630 | 8/1991 | Kaanta et al. | 451/288 |
| 5,127,196 | 7/1992 | Morimoto et al. | 451/288 |
| 5,205,076 | 4/1993 | Vernon et al. | 451/390 |
| 5,573,448 | 11/1996 | Nakazima et al. | 451/287 |
| 5,645,474 | 7/1997 | Kubo et al. | 451/288 |
| 5,695,393 | 12/1997 | Granziera | 451/390 |
| 5,766,058 | 6/1998 | Lee et al. | 451/287 |
| 5,769,692 | 6/1998 | Pasch et al. | 451/289 |

*Primary Examiner*—David A. Scherbel
*Assistant Examiner*—Derris Holt Banks
*Attorney, Agent, or Firm*—Beyer & Weaver, LLP

[57] ABSTRACT

A substrate holder assembly for forming a substantially uniformly polished substrate surface during chemical-mechanical polishing is described. The substrate holder assembly includes a carrier film having: (A) a porous layer with (i) a first surface with an outwardly protruding dome shaped region that applies pressure on at least a portion of the substrate surface during chemical-mechanical polishing and a location of the protruding dome shape is aligned with a location of an area of substrate surface that is likely to be underpolished, (ii) a second surface facing a contact surface of a backing plate; and (B) a pressure sensitive adhesive backing layer for affixing the carrier film to the contact surface of the backing plate under sufficient pressure.

28 Claims, 5 Drawing Sheets

MODIFIED CARRIER FILMS TO PRODUCE MORE UNIFORMLY POLISHED SUBSTRATE SURFACES

BACKGROUND OF THE INVENTION

The present invention relates to modified substrate holder assemblies that retain a substrate during chemical-mechanical polishing (sometimes referred to as "CMP"). More particularly, the present invention relates to modified carrier films integrated into substrate holder assemblies that retain a substrate during chemical-mechanical polishing (CMP) to produce a more uniformly polished substrate surface.

Chemical mechanical polishing (CMP) typically involves mounting a wafer faced down on a holder and rotating the wafer face against a polishing pad mounted on a platen, which in turn is rotating or in an orbital state or in linear motion. A slurry containing a chemical that chemically interacts with the facing wafer layer and an abrasive that physically removes that layer is flowed between the wafer and the polishing pad or on the pad near the wafer. In semiconductor wafer fabrication, this technique is commonly applied to polish various wafer layers such as dielectric layers, metallization, etc.

FIG. 1 shows some major components of a representative substrate holder assembly 10 that are currently integrated into a CMP apparatus. A shaft 12 lowers substrate holder assembly 10 holding a substrate 20 on a polishing pad 22 to begin CMP. Substrate holder assembly 10 includes a backing plate 14 having a convex or outwardly protruding dome shaped contact surface 15. A carrier film 18 adheres to contact surface 15 and thereby substantially conforms to protruding dome shape of the contact surface. A circumferential restraint member 16 engages the edges of substrate 20 and restrains the movement of substrate 20 outside substrate holder assembly 10. In this configuration, the protruding dome shape of contact surface 15 applies more pressure at a center region than peripheral regions of substrate 20 during CMP.

It is important to note that contact surface 15 is normally substantially planar when the substrate holder assembly is commercially obtained from manufacturers of the substrate holder assemblies, such as Integrated Processing Equipment Corporation (IPEC) of Phoenix, Ariz. At an additional cost, however, manufacturers of substrate holder assemblies may machine the contact surface to have a protruding dome shape as shown in FIG. 1 and according to specifications provided by an end user, e.g., an integrated circuit fabrication facility.

An end user may desire a contact surface having a protruding dome shaped region to effectively combat "center slow" polishing experienced by a substrate. It is well known in the art that "center slow" polishing refers to the condition when a film removal rate at a center region of a substrate surface is slower relative to the edge or peripheral regions of the substrate surface. Those skilled in the art recognize that center slow polishing conditions may set in when a polishing pad surface degrades due to repeated mechanical action of the substrate on the polishing pad during CMP. A substrate surface may suffer from center slow polishing well before the end of a production lot draws near. "Production lot" refers to a collection of substrates that are fabricated as a group under substantially similar conditions and may ultimately be sold.

Center slow polishing is undesirable because it leads to a non-uniformly polished wafer surface, i.e. the center region of the substrate surface is not polished to the same extent as the peripheral region of the substrate. In order to prevent forming non-uniformly polished substrate surfaces, the polishing pad with the degraded surface is typically replaced with a new polishing pad and the life of the polishing pad ends prematurely. In a typical integrated circuit (e.g., semiconductor wafer) fabrication facility, where several CMP apparatus are employed, the replacement cost of polishing pads can be significant.

Unfortunately, the current substrate holder assembly designs suffer from several drawbacks. By way of example, machining the contact surfaces mentioned above within the tolerances required by the end user can be an arduous, time-consuming and expensive task. Generally highly skilled workers, who may undergo extensive training, are required to perform precise machining of the contact surface. The end users, nevertheless, frequently discover that the dimensions of the protruding dome shape of the contact surface are not within the requisite tolerance levels to effectively combat center slow polishing.

Even in those instances where the dimensions of the backing plate comply with the end user's specification, the dimensions that were once deemed appropriate by the end user may no longer be suitable due to the changing parameters of the CMP system. For example, as substrate CMP proceeds through a production lot, the compressibility of the carrier film may change and/or the polishing pad characteristics are altered. In other words, the degree of center slow polishing changes as substrate CMP proceeds through a production lot. Consequently, the degree of protrusion of the dome shaped contact surface required to combat center slow polishing changes accordingly.

As another example, the protruding dome shaped of the contact surface is susceptible to undergoing deformation, e.g., formation of nicks, indentations and the like, during polishing of a production lot. The end users, therefore, may be forced to maintain several substrate holder assemblies including backing plates having varying degrees of dome shaped protrusion ready for operation in the event a backing plate is deformed or a backing plate having a different degree of dome shaped protrusion is necessary to combat the changing degree of center slow polishing.

It is well known in the art that maintaining several such substrate holder assemblies is expensive for the end user. Furthermore, the other drawbacks of the current substrate holder assembly design mentioned above translate into a lower throughput and yield of the CMP process.

What is therefore needed is an improved substrate holder assembly that facilitates in producing a more uniformly polished substrate surface, without appreciably lowering the yield or throughput of the CMP process.

SUMMARY OF THE INVENTION

To achieve the foregoing, the present invention provides a substrate holder assembly for forming a substantially uniformly polished substrate surface during chemical-mechanical polishing. The substrate holder assembly includes a carrier film having: (A) a porous layer with (i) a first surface with an outwardly protruding dome shaped region that applies pressure on at least a portion of the substrate surface during chemical-mechanical polishing and a location of the protruding dome shape is aligned with a location of an area of substrate surface that is likely to be underpolished, (ii) a second surface facing a contact surface of a backing plate; and (B) a pressure sensitive adhesive backing layer for affixing the carrier film to the contact surface of the backing plate under sufficient pressure.

The porous layer may be made from a poromeric material and may have a thickness of between about 1 and about 50 mils. The first surface of the porous layer may protrude by a distance of between about 5 and about 30 mils. The pressure sensitive adhesive backing layer may have a thickness of between about 7 and about 30 mils.

The substrate holder assembly may further include a base layer disposed between the porous layer and the pressure sensitive adhesive backing layer and supporting the porous layer. The substrate holder assembly may also further include a backing plate including a contact surface attached to the carrier film and a circumferential restraint member arranged with respect to the backing plate and adapted to engage edges of the substrate and thereby retain the substrate.

In another aspect, the present invention provides a substrate holder assembly for forming a substantially uniformly polished substrate surface during chemical-mechanical polishing. The substrate holder assembly includes a carrier film having: (A) a pressure sensitive adhesive layer with (i) a first adhesive surface with an outwardly protruding dome shaped region for applying pressure on at least a portion of the substrate surface during chemical-mechanical polishing and a location of the protruding dome shape is aligned with a location of an area of substrate surface that is likely to be underpolished, and (ii) a second adhesive surface facing a contact surface of a backing plate and under sufficient pressure affixes the carrier film to the contact surface of the backing plate; and (B) a porous layer proximate the first adhesive surface such that the porous layer substantially conforms to the protruding dome shape of the first adhesive surface.

The pressure sensitive adhesive layer may have a thickness of between about 7 and about 30 mils and the protruding dome shaped region may protrude by a distance of between about 5 and about 30 mils. The porous layer may have a thickness of between about 1 and about 50 mils. The substrate holder assembly may further include a base layer disposed between the porous layer and the pressure sensitive adhesive backing layer supporting the porous layer. The substrate holder assembly may further include a backing plate including a contact surface attached to the carrier film and a circumferential restraint member arranged with respect to the backing plate and adapted to engage edges of the substrate and thereby retain the substrate.

In yet another aspect, the present invention provides a substrate holder assembly for forming a substantially uniformly polished substrate surface during chemical-mechanical polishing. The substrate holder assembly includes a carrier film having: (A) a pressure sensitive adhesive backing layer for affixing the carrier film to the contact surface of the backing plate under sufficient pressure, (B) a base layer with (i) a first surface with an outwardly protruding dome shaped region that applies pressure on at least a portion of the substrate surface during chemical-mechanical polishing and a location of the protruding dome shape is aligned with a location of an area of substrate surface that is likely to be underpolished, and (ii) a second surface facing a contact surface of a backing plate and proximate the pressure sensitive adhesive layer; and (C) a porous layer positioned such that the base layer is disposed between the pressure sensitive adhesive layer and the porous layer.

The base layer may be made from a hard plastic material adapted to support the porous layer. The base layer may have a thickness of between about 1 and about 3 mils and the outwardly protruding dome shaped region may protrude by a distance of between about 5 and about 30 mils. The porous layer may be made from a poromeric material and may have a thickness of between about 1 and about 50 mils. The pressure sensitive adhesive layer may be a double sticky tape. The pressure sensitive adhesive layer may have a thickness of between about 7 and about 30 mils.

The substrate holder assembly may further include a backing plate including a contact surface attached to the carrier film; and a circumferential restraint member arranged with respect to the backing plate and adapted to engage edges of the substrate and thereby retain the substrate.

In yet another aspect, the present invention provides a process of forming a carrier film that is integrated into a substrate holder assembly designed to produce a substantially uniformly polished substrate surface during chemical-mechanical polishing. The process of forming the carrier film may include: (A) providing a base layer of substantially uniform thickness; (B) growing a porous layer on the base layer; and (C) machining the porous layer to form a protruding dome shaped region thereon such that a location of the protruding dome shaped region aligns with a location of an area of a substrate surface that is likely to be underpolished.

The process may further include a step of attaching the base layer to a pressure sensitive adhesive layer that is adapted to affix the carrier film to a backing plate of the substrate holder assembly. The step of machining the porous layer may include sciving at least a portion of the porous layer such that the protruding dome shaped region protrudes by distance of at least between about 5 and about 30 mils.

In yet another embodiment, the present invention provides a process of forming a carrier film that is integrated into a substrate holder assembly designed to produce a substantially uniformly polished substrate surface during chemical-mechanical polishing. The process of forming a carrier film includes: (A) providing a base layer of substantially uniform thickness; (B) machining the base layer to form a protruding dome shaped region thereon such that a location of the protruding dome shaped region aligns with a location of an area of a substrate surface that is likely to be underpolished; and (C) growing a porous layer of substantially uniform thickness on the base layer.

The process may further include a step of securing the base layer on a pressure sensitive adhesive layer that is adapted to affix the carrier film to a backing plate of the substrate holder assembly. The step of machining the base layer includes sciving at least a portion of the base layer such that the protruding dome shaped region protrudes by distance of at least between about 5 and about 30 mils.

The present invention represents a marked improvement over the current substrate holder assembly design. By way of example, the necessary pressure to combat center slow polishing of a substrate is provided by integrating the carrier films of the present invention into a substrate holder assembly as opposed to precisely machining a contact surface of a backing plate to have a protruding dome shape. The present invention, therefore, eliminates the drawbacks associated with the current substrate holder assembly design mentioned above, e.g., expensive, lowers the yield and throughput of the CMP process.

As another example, the design of the substrate holder assembly according to the present invention is easily implemented by making minor modifications to the current design. In other words, the carrier film of the present invention may be substituted for the carrier film currently employed in a conventional substrate holder assembly.

These and other advantages of the present invention will be described in more detail below in the detailed description of the invention and in conjunction with the following figures.

DETAILED DESCRIPTION OF THE PREFERRED EMBODIMENTS

Figure 1:
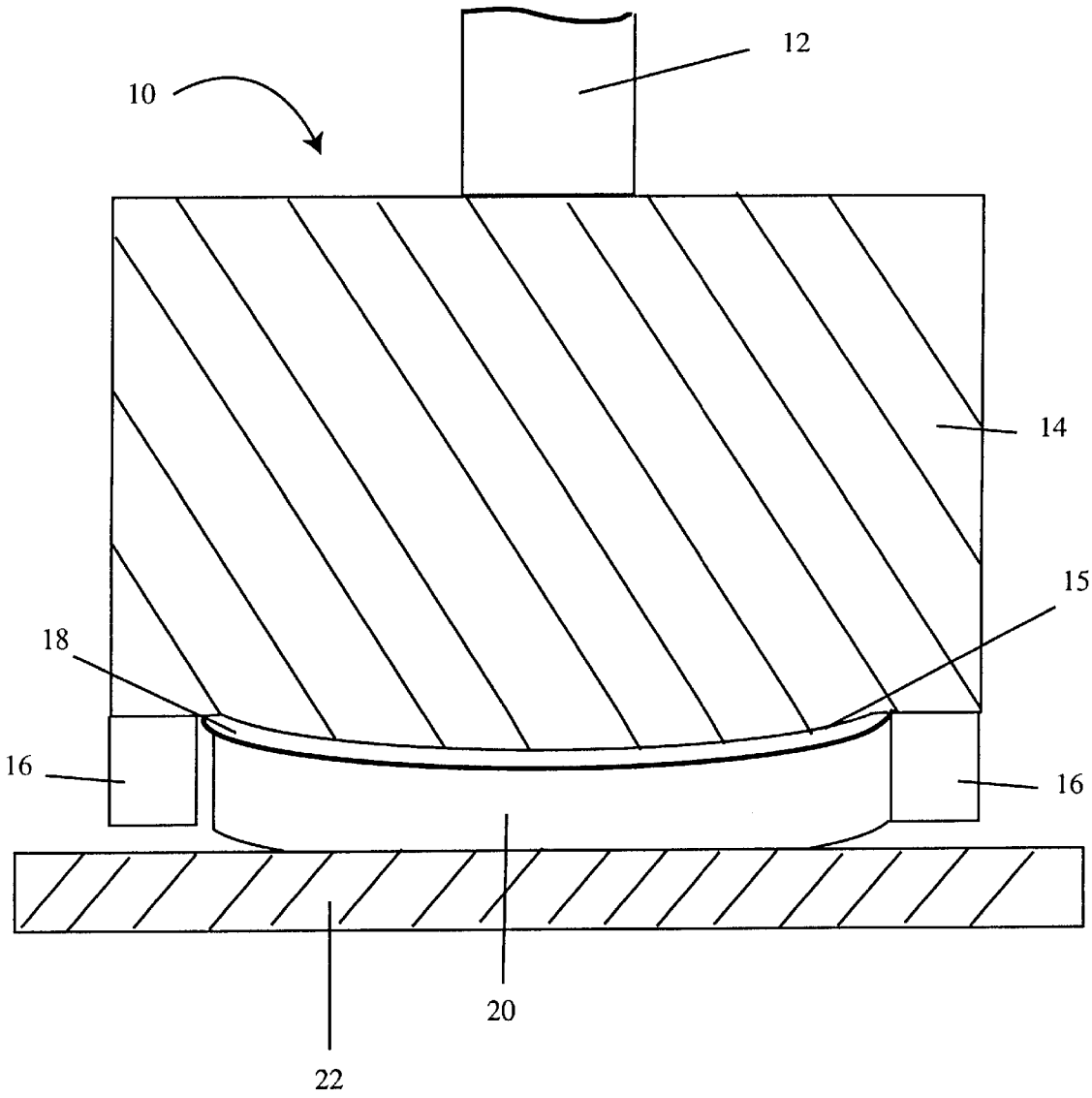
Prior Art Figure 1
FIG. 1 shows a cross-sectional view of a representative substrate holder assembly currently employed to secure a substrate during chemical-mechanical polishing.

The present invention provides modified carrier films that are integrated into substrate holder assemblies that retain a substrate during chemical-mechanical polishing (CMP) to produce a more uniformly polished substrate surface. In the following description, numerous specific details are set forth in order to fully illustrate a preferred embodiment of the present invention. It will be apparent, however, that the present invention may be practiced without limitation to some specific details presented herein. Those skilled in the art will recognize that profiles of some components of the carrier film, e.g., pressure sensitive adhesive layer, base layer, and porous layer may be exaggerated to facilitate the discussion of the present invention.

The present invention provides modified carrier films, which adhere to a contact surface of a backing plate by a pressure sensitive adhesive backing layer. The carrier films modified according to the present invention have a protruding dome shaped region that contacts and applies pressure on an area of substrate surface that is likely to be underpolished.

Although carrier films commercially available from Rodel, Inc. of Newark, Del. used in traditional CMP systems, such as the Avanti 372, commercially available from Integrated Processing Equipment Corporation (IPEC) of Phoenix, Ariz., may be shaped to have protruding dome shapes, the dome shape of the carrier films are realized by employing thermal setting processes, which are totally different from processes that use a pressure sensitive adhesive layer. Thermal setting processes employed to shape a carrier film involve sandwiching the carrier film of substantially uniform thickness between the backing plate and a carrier film fixture under significant pressure (e.g., pressure of between about 20 and about 30 psi) and temperature (e.g., pressure of between about 180 ° F.) for relatively long periods of time. A carrier film fixture surface, which contacts the carrier film, includes a concave area that recesses inwardly and under the thermal setting processes described above, the substantially planar surface of carrier film deforms to acquire the shape of the carrier film fixture and the carrier film surface is thereby shaped to have an outwardly protruding dome shape. The significant pressure and temperature applied during the thermal setting process also facilitates the bonding between the carrier film and the backing plate.

The thermal setting process suffers from several drawbacks. By way of example, the heating step of the thermal setting process is generally time-consuming, e.g., in the order of 45 minutes to 1 hour. As a further example, the carrier film shaped by the thermal setting processes fails to retain its dome shape after being used for polishing a few substrates and therefore requires relatively frequent reshaping. Often substrate fabrication facilities maintain several preshaped carrier films having dome shapes with different degrees of protrusion, which carrier films can be expensive, as mentioned above. Further still, after shaping the carrier film, the carrier film undergoes a trimming step, in which a residual portion of carrier film that is forced out during shaping is trimmed or removed. The trimming step can be a cumbersome and time-consuming task. These drawbacks of the thermal setting process lower the throughput of the CMP process.

The present invention uses a pressure sensitive adhesive backing tape, instead of a thermal setting process, to secure a poromeric layer of the carrier film to the backing plate. In order to use the pressure sensitive adhesive layer for affixing the carrier film to a contact surface, an adhesive backing is removed to expose an adhesive surface of the pressure sensitive adhesive layer to the contacts surface. Next, upon applying sufficient pressure (e.g., between about 3 and about 10 psi) on the adhesive tape for about 10 and about 20 minutes, the carrier film is affixed to the contact surface of the backing plate. As a result, cumbersome and time-consuming task of trimming performed in thermal setting processes is totally eliminated. The pressure sensitive adhesive layer requires less pressure for shorter periods of time and does not suffer from the drawbacks of the thermal setting process mentioned above. The process throughput is also increased by the use of pressure sensitive adhesive tape because the requisite amount of pressure necessary for affixing the carrier film to the backing plate may be applied during a pad preconditioning or break-in process, which is well known in the art. Thus, a separate step of applying pressure for affixing the carrier film to the backing plate is not necessary as it is in the thermal setting process. End users of carrier films, e.g. integrated circuit fabrication facilities, therefore prefer using carrier films that include pressure sensitive adhesive backing tape over carrier films that require thermal setting process for shaping the carrier film.

According to one embodiment, the carrier film of the present invention includes a porous layer and a pressure sensitive adhesive layer. The porous layer includes a first and second surface. The first surface includes an outwardly protruding dome shaped region, the location of which is aligned with the location of an area of substrate surface that is likely to be underpolished, e.g., if a conventional substrate holder assembly is employed. During CMP, according to the present invention, the protruding dome shaped region of the porous layer applies pressure on that area of the substrate surface that is likely to be underpolished and thereby produces a substantially uniformly polished substrate surface. The second surface of the porous layer may adhere to a pressure sensitive adhesive backing layer on one side, while the other side of the pressure sensitive adhesive backing layer is affixed to the contact surface of the backing plate.

Figure 2:
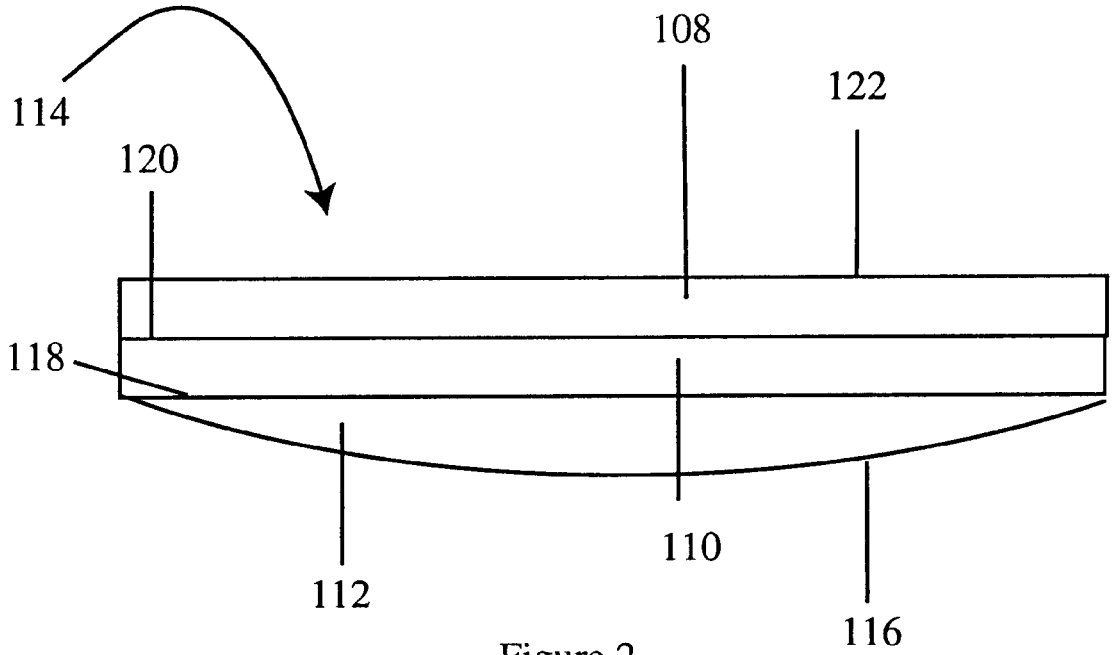
FIG. 2 shows a cross-sectional view of a carrier film, according to one embodiment of the present invention.

FIG. 2 shows a preferred embodiment of a carrier film of the present invention. In this embodiment, a carrier film 114 includes a base layer 110 disposed between a pressure sensitive adhesive layer 108 and a porous layer 112. Porous layer 112 includes a first surface 116, which has a protruding dome shape, and a second surface 118 that contacts base layer 110. Pressure sensitive adhesive layer 108 includes a first adhesive surface 120 that adheres to base layer 110 and a second adhesive surface 122 that is adapted to affix carrier film 114 to a contact surface of a backing plate as shown below.

Figure 3:
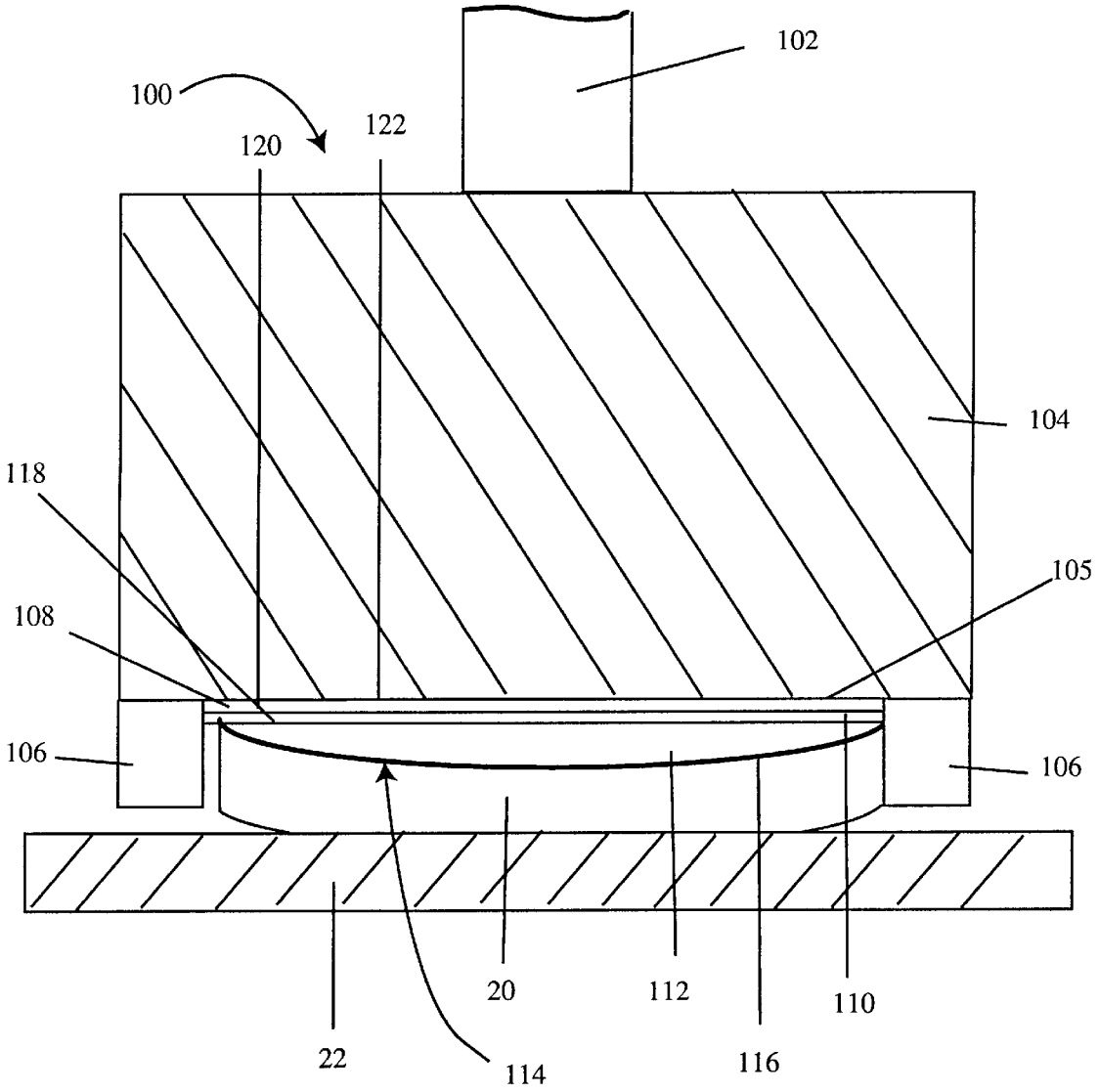
FIG. 3 shows the carrier film of FIG. 2 integrated into a substrate holder assembly.

FIG. 3 shows a modified substrate holder assembly 100, according to one embodiment of the present invention, including carrier film 114 of FIG. 2. Substrate holder assembly 100 includes a backing plate 104 having a contact surface 105, affixed to which is carrier film 114. As mentioned before, adhesion of carrier film 114 to contact surface 105 is facilitated by applying sufficient pressure at a second adhesive surface 122 of pressure sensitive adhesive layer 108. A substrate 20 contacts the protruding dome shape of first surface 116 of porous layer 112 and is retained by a circumferential restraint member 106, which restrains the movement of substrate 20 outside substrate holder assembly 100.

During CMP, a shaft 102 lowers substrate holder 100 such that substrate 20 contacts a polishing pad 22. An actuator or a motor, which is connected to shaft 104, allows substrate holder assembly 100 to rotate about an axis that passes through a center point of backing plate 104. In this configuration, the protruding dome shape of porous layer 112 applies pressure on a center area of a substrate surface, which may be underpolished in a conventional substrate holder assembly if center slow polishing conditions have set in. Therefore, by aligning the location of the protruding dome shaped region on first surface 116 of porous layer 112 with the location of an area of substrate 20 that is likely to be underpolished, more pressure is delivered to such an area of substrate 20 to enhance the film removal rate in that area. Consequently, substrate holder assembly that employs a carrier film design modified according to the present invention produces a substantially uniformly polished substrate surface.

Shaft 104 may be a hollow body, through which the necessary provisions to maintain vacuum conditions for the robotic transport of substrate 20 and to supply the required back pressure during CMP are provided. Shaft 104 may be made from metal, such as aluminum or stainless steel. Backing plate may be made from a rigid material, which may include at least one of anodized aluminum, stainless steel or ceramic material. Substrate 20 may include integrated circuit substrates, such as semiconductor wafer substrates, optical substrates, magnetic media substrates, etc.

Pressure sensitive adhesive layer 108 may include a double-sided tape that has first adhesive surface 120 adapted to adhere to a base layer 110 or porous layer 112 and second adhesive surface 122 adapted to adhere to contact surface 105 of backing plate 104 under sufficient pressure. The thickness of pressure sensitive adhesive layer 108 may be between about 7 and about 30 mils.

Base layer 110 may be made from a rigid plastic material, such as Mylar®, which is a trademark of E. I. du Pont de Nemours Company and commercially available from distributors like EIS Company of Atlanta, Ga. The thickness of base layer 110 may be between about 1 and about 3 mils.

Porous layer 112 may be made from a poromeric material, e.g., polyurethane and rubber materials. The thickness of porous layer 112 may be between about 1 and about 50 mils and first surface 116 may outwardly protrude by a distance of between about 5 and about 30 mils.

According to one embodiment of the present invention, a process of fabricating carrier film 114 may begin by obtaining a base layer, preferably a layer of Mylar® mentioned above, of substantially uniform thickness. A porous layer, e.g., a poromeric material, of substantially uniform thickness may then be grown on the base layer according to methods well known to those skilled in the art. The porous layer is then machined, e.g., by sciving a portion of the porous layer, to form a protruding dome shaped region thereon having dimensions mentioned above. Next, the location of the protruding dome shaped region is aligned with the location of an area of substrate surface that is likely to be underpolished if conventional substrate holder assemblies were employed during CMP. The base layer is then affixed to an adhesive surface of a pressure sensitive adhesive surface by applying sufficient pressure and thereby forming carrier film 114 shown in FIG. 2.

Figure 4:
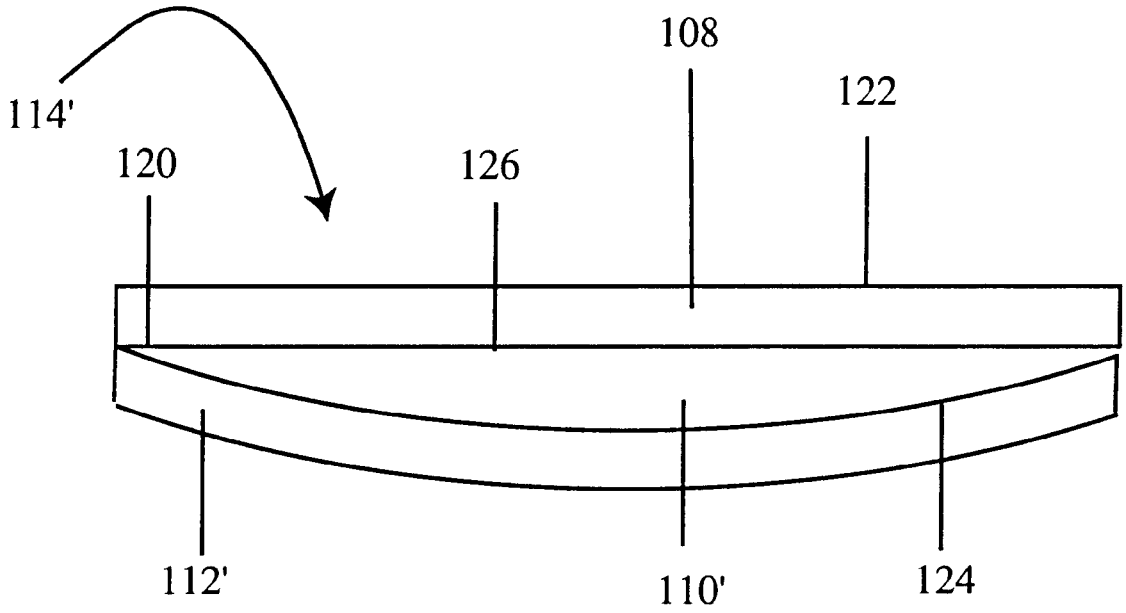
FIG. 4 shows a cross-sectional view of another carrier film, according to another embodiment of the present invention.

The outwardly protruding dome shaped region of a carrier film, according to the present invention, may be realized in other ways. By way of example, FIG. 4 shows a carrier film 114', according to another embodiment of the present invention. In this embodiment, base layer 110' is sandwiched between pressure sensitive adhesive layer 108 and a porous layer 112'. Base layer 110' includes a first surface 124 and a second surface 126. First surface 124 contacts porous layer 112' and has a protruding dome shaped region, the location of which is aligned with a center area of a substrate surface that is likely to be underpolished if a conventional substrate holder assembly is employed and center slow polishing conditions set in. Second surface 126 adheres to pressure sensitive adhesive layer 108 typically by applying sufficient pressure at points of contact between pressure sensitive adhesive layer 108 and base layer 110'.

Porous layer 112' is substantially similar to porous layer 112 of FIG. 2, except porous layer 112' of FIG. 4 is of substantially uniform thickness that may be between about 1 and about 50 mils. Base layer 110' may have a thickness that is between about 1 and about 3 mils and the protruding dome shape may protrude by a distance that is between about 5 and about 30 mils. Those skilled in the art will recognize that carrier film 114' of FIG. 4 may be integrated into a substrate holder assembly substantially similarly as shown in FIG. 3.

According to another embodiment of the present invention, a process of fabricating carrier film 114' may begin by obtaining a base layer, preferably a layer of Mylar® mentioned above, of substantially uniform thickness. A first surface 124 of the base layer is then machined, e.g., by sciving a portion of the base layer, to form a protruding dome shaped region thereon having dimensions mentioned above. A porous layer 112' of substantially uniform thickness may then be grown on first surface 124 according to methods well known to those skilled in the art. Next, the location of the protruding dome shaped region is aligned with the location of an area of substrate surface that is likely to be underpolished if conventional substrate holder assemblies were employed during CMP. The base layer at a second surface is then Iaffixed to an adhesive surface of a pressure sensitive adhesive layer 108 by applying sufficient pressure and thereby forming carrier film 114' shown in FIG. 4.

Figure 5:
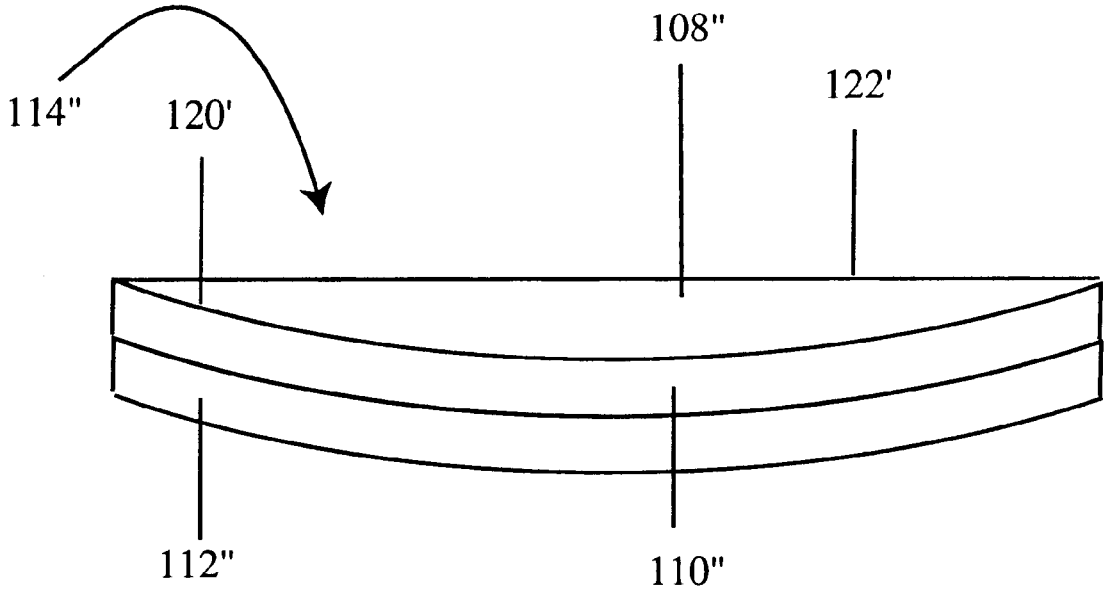
FIG. 5 shows a cross-sectional view of yet another carrier film, of, according to yet another embodiment of the present invention.

As yet another example of a carrier film having a protruding dome shape, FIG. 5 shows a carrier film 114" that includes a base layer 110" sandwiched between a pressure sensitive adhesive backing layer 108" and a porous layer 112". Pressure sensitive adhesive layer 108" has a first adhesive surface 120' and a second adhesive surface 122'. First surface 120' adheres to base layer 110" and has an outwardly protruding dome shaped region. Second surface 122" is adapted to adhere to a contact surface of a backing plate under sufficient pressure. Carrier film 114" is integrated into a substrate holder assembly substantially similarly as shown in FIG. 3.

Pressure sensitive adhesive layer has a thickness of between about 7 and about 30 mils and first adhesive surface 120' protrudes by a distance of between about 5 and about 30 mils. The base layer 110" is substantially similar to base layer 110 of FIG. 2 and porous layer 112" is substantially similar to porous layer 112' of FIG. 4, except base layer 110" and porous layer 112' are disposed above a protruding dome shaped pressure sensitive adhesive layer.

The present invention represents a marked improvement over the current substrate holder assembly design. By way of example, the necessary pressure to combat center slow polishing of a substrate is provided by integrating the carrier films of the present invention into a substrate holder assembly as opposed to precisely machining a contact surface of a backing plate to have a protruding dome shape. The present invention, therefore, eliminates the drawbacks associated with the current substrate holder assembly design mentioned above, e.g., expensive, lowers the yield and throughput of the CMP process.

As another example, the design of the substrate holder assembly according to the present invention is easily implemented by making minor modifications to the current design. In other words, the carrier film of the present invention may be substituted for the carrier film currently employed in a conventional substrate holder assembly.

Although the foregoing invention has been described in some detail for purposes of clarity of understanding, it will be apparent that certain changes and modifications may be practiced within the scope of the appended claims. For example, while the specification has described the substrate holder assemblies of the present invention to be used in the context of integrated circuit of semiconductor wafer CMP, there is no reason why in principle such substrate holder assemblies could not be used in other polishing applications, e.g., polishing optical substrates, magnetic media substrates, etc. Therefore, the present embodiments are to be considered as illustrative and not restrictive, and the invention is not to be limited to the details given herein, but may be modified within the scope of the appended claims.

What is claimed is:

1. A substrate holder assembly for forming a substantially uniformly polished substrate surface during chemical-mechanical polishing, comprising:

a carrier film of non-uniform thickness including a porous layer having (i) a first surface with an outwardly protruding dome shaped region that applies pressure on at least a portion of a substrate surface during chemical-mechanical polishing and a location of said protruding dome shape is aligned with a location of an area of said substrate surface that is likely to be underpolished, (ii) a second surface facing a contact surface of a backing plate; and, a pressure sensitive adhesive backing layer for affixing said carrier film to said contact surface of said backing plate under sufficient pressure.

2. The substrate holder of claim 1, wherein said porous layer is made from a poromeric material.

3. The substrate holder of claim 1, wherein said porous layer has a thickness of between about 1 and about 50 mils.

4. The substrate holder of claim 1, wherein said first surface protrudes by between about 5 and about 30 mils.

5. The substrate holder of claim 1, wherein said pressure sensitive adhesive backing layer has a thickness of between about 7 and about 30 mils.

6. The substrate holder assembly of claim 1, further comprising a base layer disposed between said porous layer and said pressure sensitive adhesive backing layer and suitable for supporting said porous layer.

7. The substrate holder assembly of claim 1, further comprising:

a backing plate including a contact surface attached to said carrier film; and a circumferential restraint member arranged with respect to said backing plate and adapted to engage one or more edges of the substrate and thereby retain said substrate.

8. A substrate holder assembly for forming a substantially uniformly polished substrate surface during chemical-mechanical polishing, comprising:

a carrier film including a pressure sensitive adhesive layer having (i) a first adhesive surface with an outwardly protruding dome shaped region for applying pressure on at least a portion of a substrate surface during chemical-mechanical polishing and a location of said protruding dome shape is aligned with a location of an area of said substrate surface that is likely to be underpolished, (ii) a second adhesive surface faces a contact surface of a backing plate and under sufficient pressure affixes said carrier film to said contact surface of said backing plate; and a porous layer proximate said first adhesive surface such that said porous layer substantially conforms to said protruding dome shape of said first adhesive surface.

9. The substrate holder of claim 8, wherein said pressure sensitive adhesive layer has a thickness of between about 7 and about 30 mils.

10. The substrate holder of claim 8, wherein said protruding dome shaped region protrudes by between about 5 and about 30 mils.

11. The substrate holder of claim 8, wherein said porous layer has a thickness of between about 1 and about 50 mils.

12. The substrate holder assembly of claim 8, further comprising a base layer disposed between said porous layer and said pressure sensitive adhesive backing layer and suitable for supporting said porous layer.

13. The substrate holder assembly of claim 8, further comprising:

a backing plate including a contact surface attached to said carrier film; and a circumferential restraint member arranged with respect to said backing plate and adapted to engage one or more edges of the substrate and thereby retain said substrate.

14. A substrate holder assembly for forming a substantially uniformly polished substrate surface during chemical-mechanical polishing, comprising:

a carrier film including a pressure sensitive adhesive backing layer for affixing said carrier film to a contact surface of a backing plate under sufficient pressure, a base layer having (i) a first surface with an outwardly protruding dome shaped region that applies pressure on at least a portion of a substrate surface during chemical-mechanical polishing and a location of said protruding dome shape is aligned with a location of an area of said substrate surface that is likely to be underpolished, and (ii) a second surface facing a contact surface of a backing plate and proximate said pressure sensitive adhesive layer; and a porous layer positioned such that said base layer is disposed between said pressure sensitive adhesive layer and said porous layer.

15. The substrate holder assembly of claim 14, wherein said base layer is made from a hard plastic material adapted to support said porous layer.

16. The substrate holder assembly of claim 14, wherein said base layer has a thickness of between about 1 and about 3 mils.

17. The substrate holder assembly of claim 14, wherein said outwardly protruding dome shaped region protrudes by a distance of between about 5 and about 30 mils.

18. The substrate holder assembly of claim 14, wherein said porous layer is made from a poromeric material.

19. The substrate holder assembly of claim 14, wherein said porous layer has a thickness of between about 1 and about 50 mils.

20. The substrate holder assembly of claim 14, wherein said pressure sensitive adhesive layer is a double sticky tape.

21. The substrate holder assembly of claim 14, wherein said pressure sensitive adhesive layer has a thickness of between about 7 and about 30 mils.

22. The substrate holder assembly of claim 14, further comprising:

a backing plate including a contact surface attached to said carrier film; and a circumferential restraint member arranged with respect to said backing plate and adapted to engage one or more edges of the substrate and thereby retain said substrate.

23. A process of forming a carrier film that is integrated into a substrate holder assembly designed to produce a substantially uniformly polished substrate surface during chemical-mechanical polishing, comprising:

providing a base layer of substantially uniform thickness;

growing a porous layer on said base layer; and machining said porous layer to form a protruding dome shaped region thereon such that a location of said protruding dome shaped region aligns with a location of an area of a substrate surface that is likely to be underpolished.

24. The process of claim 23, further comprising attaching said base layer to a pressure sensitive adhesive layer that is adapted to affix the carrier film to a backing plate of the substrate holder assembly.

25. The process of claim 23, wherein said machining said porous layer includes sciving at least a portion of said porous layer such that said protruding dome shaped region protrudes by distance of at least between about 5 and about 30 mils.

26. A process of forming a carrier film that is integrated into a substrate holder assembly designed to produce a substantially uniformly polished substrate surface during chemical-mechanical polishing, comprising:

providing a base layer of substantially uniform thickness;

machining said base layer to form a protruding dome shaped region thereon such that a location of said protruding dome shaped region aligns with a location of an area of a substrate surface that is likely to be underpolished; and growing a porous layer of substantially uniform thickness on said base layer.

27. The process of claim 26, further comprising securing said base layer on a pressure sensitive adhesive layer that is adapted to affix the carrier film to a backing plate of the substrate holder assembly.

28. The process of claim 26, wherein said machining said base layer includes sciving at least a portion of said base layer such that said protruding dome shaped region protrudes by distance of at least between about 5 and about 30 mils.

* * * * *